US008820389B1

(12) United States Patent
Degler

(10) Patent No.: US 8,820,389 B1
(45) Date of Patent: Sep. 2, 2014

(54) COMPOSITE CORE FOR THE CASTING OF ENGINE HEAD DECKS

(71) Applicant: Brunswick Corporation, Lake Forest, IL (US)

(72) Inventor: Mark T. Degler, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 13/665,653

(22) Filed: Oct. 31, 2012

(51) Int. Cl.
*B22D 17/00* (2006.01)
*B22D 29/00* (2006.01)
*B22C 9/10* (2006.01)

(52) U.S. Cl.
USPC ..... 164/113; 164/132; 164/369; 164/522

(58) Field of Classification Search
USPC ..... 164/520, 522, 113, 132, 137, 369
See application file for complete search history.

(56) References Cited

U.S. PATENT DOCUMENTS 4,446,906 A * 5/1984 Ackerman et al. ..... 164/112
4,875,517 A 10/1989 Donahue et al.
6,478,073 B1 11/2002 Grebe et al.
6,886,505 B2 5/2005 Laufenberg et al.
7,013,948 B1 3/2006 Grebe et al.
8,574,476 B2 * 11/2013 Yamada ..... 264/219
2009/0288797 A1 * 11/2009 Yaokawa et al. ..... 164/271
2010/0116230 A1 * 5/2010 Graf et al. ..... 123/41.72
2011/0062624 A1 * 3/2011 Yamada ..... 264/219
2011/0174246 A1 * 7/2011 Graf et al. ..... 123/41.72

OTHER PUBLICATIONS

Engine road map, Case Study, Edertek Technology Center, Engine Technology International.com, Jan. 2012, p. 84.

* cited by examiner

*Primary Examiner* — Kevin P Kerns
(74) *Attorney, Agent, or Firm* — Andrus Intellectual Property Law, LLP

(57) ABSTRACT

A method for the high pressure die casting of an engine block assembly having at least one cast in place cylinder bore in the engine block and a closed head deck surface, and the resultant engine block are disclosed. This closed deck high pressure die cast engine block assembly will preferably have at least two cast in place cylinder bores in the engine block formed by using a composite core of salt core material supported by at least one cylinder bore to be cast in place. The cylinder bores have a lower outer surface preferably defining at least one surface area that interfaces with the engine block during casting such that the at least one cylinder is cast in place in the engine block. An engine block water jacket—as defined by the salt core portion of the composite core—will preferably provide an open passage between each cylinder bore such that water may flow around and entire outer circumference of the upper outer surface of the cylinder bores. This provides better and more uniform cylinder wall cooling, reducing thermal hot spotting and bore wall distortion.

15 Claims, 3 Drawing Sheets

COMPOSITE CORE FOR THE CASTING OF ENGINE HEAD DECKS

BACKGROUND AND SUMMARY

The current disclosure relates to the high pressure die casting of metallic objects, more specifically the high pressure die casting of metallic engine components using a composite core of salt and objects to be cast-in-place, and particularly to the high pressure die casting of closed deck engine block for internal combustion engines using a composite core of salt and cast-in-place cylinder bore surfaces or liners.

Internal combustion engine blocks were formerly constructed entirely of cast iron. However, such constructions were considered to be too heavy and a lighter weight material was sought. Aluminum alloy engine blocks added the advantage of being lightweight, but the cylinder bore surfaces of such engine blocks were overly susceptible to wear. In order to militate against excessive wear, lining or plating of the cylinder bore surfaces was developed or cast iron cylinder liners were used. However, while the cast iron cylinder bore liners provide the necessary wear resistance, they fail to meet today's more strict emissions requirements.

The construction of engine blocks has now evolved to where engine blocks are cast with a low pressure die cast process using sand cores, salt cores, permanent molds or lost foam casting technology. Brunswick patent No. 4,875,517 entitled "Method of producing salt cores for use in die casting" describes a method of producing salt cores for use in traditional die casting by means of an evaporative foam pattern held in place with sand. Brunswick patent #7,013,948 entitled "Disintegrative Core for use in use in Die Casting of Metallic Components" details the manufacture of salt cores with a vent opening to allow gases to pass inward through the body of the salt core and away from the salt core's outer surface. This salt core technology is used in traditional high pressure die casting to produce engine blocks and engine head decks.

Typically, aluminum silicon alloys, including eutectic, hypereutectic aluminum silicon alloys (i.e. those Al—Si alloys having greater than 11.6% by weight silicon), and hypoeutectic aluminum silicon alloys (i.e. those Al—Si alloys having less than 11.6% by weight silicon), or magnesium alloys are utilized in constructing engine blocks with lower oil consumption, while also creating engines having significantly low weight and high durability. While construction of such an engine block cast in a low pressure die cast process will meet emission standards these engine blocks are, however, very expensive, not only because of the machining difficulties associated with engine blocks having high silicon content or high hardness for other metallurgical reasons, but also because the low pressure die casting process has an inherently longer cycle time, more than double that of high pressure die casting.

However, the high pressure die casting method is limited. The use of sand cores made from sand compressed within a geometric mold and held together with an organic binder remain confined to use in low pressure casting methods due to the fragile nature of the core body. Likewise, salt cores are too fragile to withstand the influx of pressurized molten metal while retaining their necessary shape. Particularly, the intricacies of the head decks of engine blocks are problematic to cast with high pressure die casting because of tight tolerances between cylinder bores and the water cooling jackets surrounding the cylinder bores, which generally require sand or salt core technology. Such engine head decks are even more problematic when the casting requires a closed deck where only a selected area is open to the water cooling jacket area. Closed deck engine blocks are characterized by a water jacket that is substantially closed at the top portion of the engine block, with the exception of any relatively small passages that may be present.

Thus, the water cooling passages of open deck high pressure die cast aluminum engine blocks are currently produced such that the combustion cylinders are formed using metallic cores on the inner diameter and outer diameter that leaves the cylinder walls free-standing. This condition does not provide good structural strength to the cylinder in operation due to the high levels of stress caused during combustion, compression, and thermal stresses during engine operation. Specifically, the lack of head deck bridges in a high pressure die cast block does not provide solid support of the cylinder in operation. Moreover, the water jackets of open deck type engine blocks have to be sealed during the cylinder head assembly. This sealing process is generally very fault-prone and involved. Because of these drawbacks, large displacement aluminum engine blocks having high mechanical and thermal stress loads have not typically been produced using high pressure die casting.

While a closed deck engine block affords significantly greater load support, the prior art was limited in its ability to produce the optimum water jacket cooling passage geometry combined with the desired structural rigidity of a closed deck engine block. In that regard, Brunswick U.S. Pat. No. 6,478,073 is also directed to a "Composite Core for Casting Metallic Objects" The patent details the manufacture of a salt core using a metallic arbor to provide structural support. These cores are produced using high pressure die casting and molten salt surrounding an aluminum arbor. The rigid nature of the internal arbor provides structural stability necessary for the forces of molten metal put upon the core during high pressure casting processes. The salt/aluminum core are subsequently placed in a high pressure die casting die and an aluminum engine "head" is cast around it. After casting, the salt core is dissolved by flushing with water and the aluminum arbor is extracted, leaving a cored cavity in place of the salt core. However, the arbor support in inadequate for the casting of closed deck engine blocks because the nature of the closed deck prevents the arbor from being removed. Conversely, without using an arbor as described in the '073 patent, a salt core is too fragile to withstand the high pressure die casting forces.

One solution for this closed head deck problem in high pressure die casting noted in the art is Ford Global Technologies, LLC U.S. Pat. No. 6,886,505 entitled "Cylinder block and die-casting method for producing same". This patent details the production of high pressure die cast engine blocks with a closed deck water jacket by means of die core opening on the exterior surfaces of the engine block casting. However, the water jacket is open towards the engine block core requiring covers to be added to seal the water jacket with bolts. Thus, the water jacket is not fully closed when cast, nor is the engine block a unitary casting. This non-unitary casting and cover requirement adds additional steps to the manufacturing process and creates a risk of leaks that would not be present should the closed deck water jackets be a unitary casting.

Applicants are also aware of prototype cores and engine blocks produced by Buhler Die Casting Machinery of Germany and VW Automotive of Germany. Buhler developed a salt core for placement in a high pressure die cast die to form simple shape cored passages for water jacket cooling and a fully closed head deck. The cores are placed into the die and located with through-wall hole details that extend into the die. The engine block and cylinders are then cast using a hypereutectic aluminum silicon alloy. The inside of the cylinder wall is formed with a retractable, cylindrical, water-cooled tool steel core. The outer wall of the cylinder is formed by the salt core. After casting, the salt core is washed from the casting leaving the water cooling jacket passage open under the closed head deck of the block. However, since the salt core is fragile and unsupported, the prototypes have been relatively unsuccessful in that the salt cores fail during casting creating an unacceptable number of blocks that must be scrapped.

Accordingly, prior to the present invention, tooling and manufacturing trade-off decisions based the design stresses of the engine and the capability of the existing technology. Manufacturers were limited in their ability to produce the optimum water jacket cooling passage geometry while maintaining the desired structural rigidity of a closed deck engine block.

The present disclosure allows for significant increases in design flexibility and economy. Utilizing salt cores to form the water jacket passage beneath the head deck while incorporating a cast in place cylinder sleeve to locate the core prior to casting creates an advantageous method for the high pressure die casting of closed deck engine blocks. With the present invention, the inside diameter of the cast in place sleeves form the walls of the combustion cylinder, while the outer diameter of the sleeves define the water cooling chamber interface with the cylinder. The integrally cast cylinder sleeves, being part of the composite salt core, gives the cores structural rigidity and positive location. The size and shape of the salt cored passage is greatly enlarged and expanded, to create geometries similar to what could only be achieved with prior art traditional die cast engine blocks using bonded sand cores or lost foam with salt cores. Accordingly, the present invention creates enhanced closed deck geometries with substantially more efficiency by using the high pressure die casting process.

To provide positive location in the aluminum die casting die and sufficient wall thickness of the head deck, the cast in place cylinder sleeves extend beyond the salt core such that a portion of the cast in place sleeves are seated in the die casting die. While cylinder sleeves are traditionally constructed from cast iron, in this disclosure the cylinder sleeves are produced from any of several materials: cast iron, steel, hyper-eutectic cast aluminum coated hypo-eutectic aluminum, or ceramic composite material. To locate the cylinder sleeves in the salt core, the salt core is molded around the cylinder sleeves to create the composite core. Alternatively, the cylinder sleeves may be pressed into location within the salt core prior to the assembled salt core and cylinder sleeve being placed into the aluminum high pressure die casting die. By creating the composite cylinder sleeve and salt core, the complexity and size of the salt cores used in high pressure die casting can be greatly increased compared to that demonstrated by prior art because the cylinder sleeves provide support that was heretofore not available.

Accordingly, the present disclosure is directed to a method for casting an engine block assembly having at least one cast in place cylinder bore in the engine block and a closed head deck surface. The method comprises first creating a composite core of salt core material and at least one cylinder bore by surrounding an outer, upper surface of at least one cylinder bore with a salt core to create a composite core. The cylinder bores may be formed from any acceptable cylinder bore material as is well known by those of skill in the art, and may further include coatings or other treatments thereon. In one embodiment, the cylinder bore material is selected from a hypereutectic aluminum silicon alloy having a solidus melting point higher than the alloy of the engine block, preferably AA390 or AA391; cast iron; ductile iron; steel. Alternatively or additionally, any of the cylinder bore materials previously noted may have a ceramic composite material coating such as NIKASIL®, a chrome coating, or other coatings as known to those of skill in the art. Further, the outer diameter of the cylinder bore, i.e. the surface interfacing with the water jacket, may be lined with aluminum or another corrosion resistant alloy or material, particularly if the cylinder is constructed from cast or ductile iron.

The area defined by the salt core portion of the composite core defines at least the water jacket surrounding the cylinder bores in the finished closed deck engine block assembly. The salt core may further define orifices or holding pocket locations in the closed head deck surface to allow for the circulation of water through the water jacket and an area for interlace with other engine components, as well as proving a means for flushing out the salt core material when the casting, in completed.

Surrounding the cylinder bore or bores with the salt core may be accomplished by placing at least one cylinder bore in a salt core mold, injecting liquid salt core material into the mold to surround the outer, upper surface of at least one cylinder bore; then solidifying the salt core material to create a composite core. The composite core is then removed from the salt core mold and prepared for placement in a die casting mold. Alternatively, the step of surrounding the cylinder bore or bores may be accomplished by injecting, liquid salt core material into a salt core mold, with the salt core mold defining a water jacket and an area for receiving at least one cylinder bore. The salt core material is then solidified, removed from the mold and at least one cylinder bore is pressed into the area for receiving at least one cylinder bore to form the composite core.

The composite core is then placed into a high pressure die casting mold for a closed deck engine block. The composite core may be placed into the high pressure die casting mold for a closed deck engine block such that a lower outer surface of the at least one cylinder bore is exposed, e.g. not surrounded by salt core material. This may be accomplished, for instance, by seating the lower outer surface of the at least one cylinder bore into at least one cylinder bore seat in the high pressure die casting mold. In one embodiment, the exposed lower outer surface of the at least one cylinder bore comprises additional surface area to interface with the engine block alloy. In another embodiment, this additional surface area comprises circumferential grooves.

After the composite core is placed in the high pressure die casting mold, an engine block alloy is injected into the high pressure die casting mold. In one embodiment, the engine block alloy is injected into the high pressure die casting mold such that the alloy interfaces with the exposed lower outer surface of the at least one cylinder bore so that the cylinder bore is cast into place in the engine block. The engine block alloy may be an Aluminum-Silicon alloy selected from any of the following [all Aluminum Association designations (AA) as will be recognized by those of skill in the art]: AA319, AA320, AA328, AA332, AA333, AA336, AA339, AA354, AA355, AA356, AA357, AA358, AA359, AA360, AA361, AA362, AA363, AA365, AA380, AA383, AA390, and AA391. Alternatively the engine block alloy may be a Magnesium alloy selected from any of the following: AM-SC1, AJ-62, AZ-91, AZ-92, AM60A, and AM60B.

The cast engine block and composite core are removed from the high pressure die casting mold as a single engine block assembly. At this time, solution heat treating, quenching or artificial age hardening or other further refinement may be conducted if desired. The engine block assembly is allowed to cool, and may be subjected to further finishing after cooling. The salt core portion of the composite core is dissolved after cooling. Dissolution of the salt core portion is accomplished by flushing water or other fluid through orifices in the closed deck surface.

By using this above-described method, a high pressure die cast engine block assembly comprising a closed deck engine block may be created. This closed deck high pressure die cast engine block assembly will preferably have at least two cast in place cylinder bores in the engine block. The cylinder bores have a top surface and an outer surface, the outer surface defining an upper outer surface and a lower outer surface, the lower outer surface further defining at least one surface area that interfaces with the engine block during casting such that the at least one cylinder is cast in place in the engine block.

This closed deck high pressure die cast engine block assembly will also have a water jacket surrounding the upper outer surface of the cylinder bores, and defines an inner surface of the water jacket. A top surface of the water jacket is closed by a head deck surface extending from the top surface of the cylinder bore or bores to an outer perimeter of the engine block. The water jacket—as defined by the salt core portion of the composite core—will preferably provide an open passage between each cylinder bore such that water may flow around and entire outer circumference of the upper outer surface of the cylinder bores. This provides better and more uniform cylinder wall cooling, reducing thermal hot spotting and bore wall distortion.

This closed deck high pressure die cast engine block assembly may be constructed from any of the following Aluminum-Silicon alloys AA319, AA320, AA328, AA332, AA333, AA336, AA339, AA354, AA355, AA356, AA357, AA358, AA359, AA360, AA361, AA362, AA363, AA365, AA380, AA383, AA390, and AA391. Alternatively, the closed deck high pressure die cast engine block assembly may be constructed from any of the following Magnesium alloys: AM-SC1, AJ-62, AZ-91, AZ-92, AM60A, and AM60B. In a similar respect, and as noted above, the cylinder bores may be formed from any acceptable cylinder bore material as is well known by those of skill in the art, and may further include coatings or other treatments thereon. In one embodiment, the cylinder bore material is selected from a hypereutectic aluminum silicon alloy having a solidus melting point higher than the alloy of the engine block; cast iron; steel; or a ceramic composite material.

BRIEF DESCRIPTION OF THE DRAWINGS

The drawings illustrate the best mode presently contemplated of carrying out the invention.

In the drawings.

DETAILED DESCRIPTION

Figure 1:
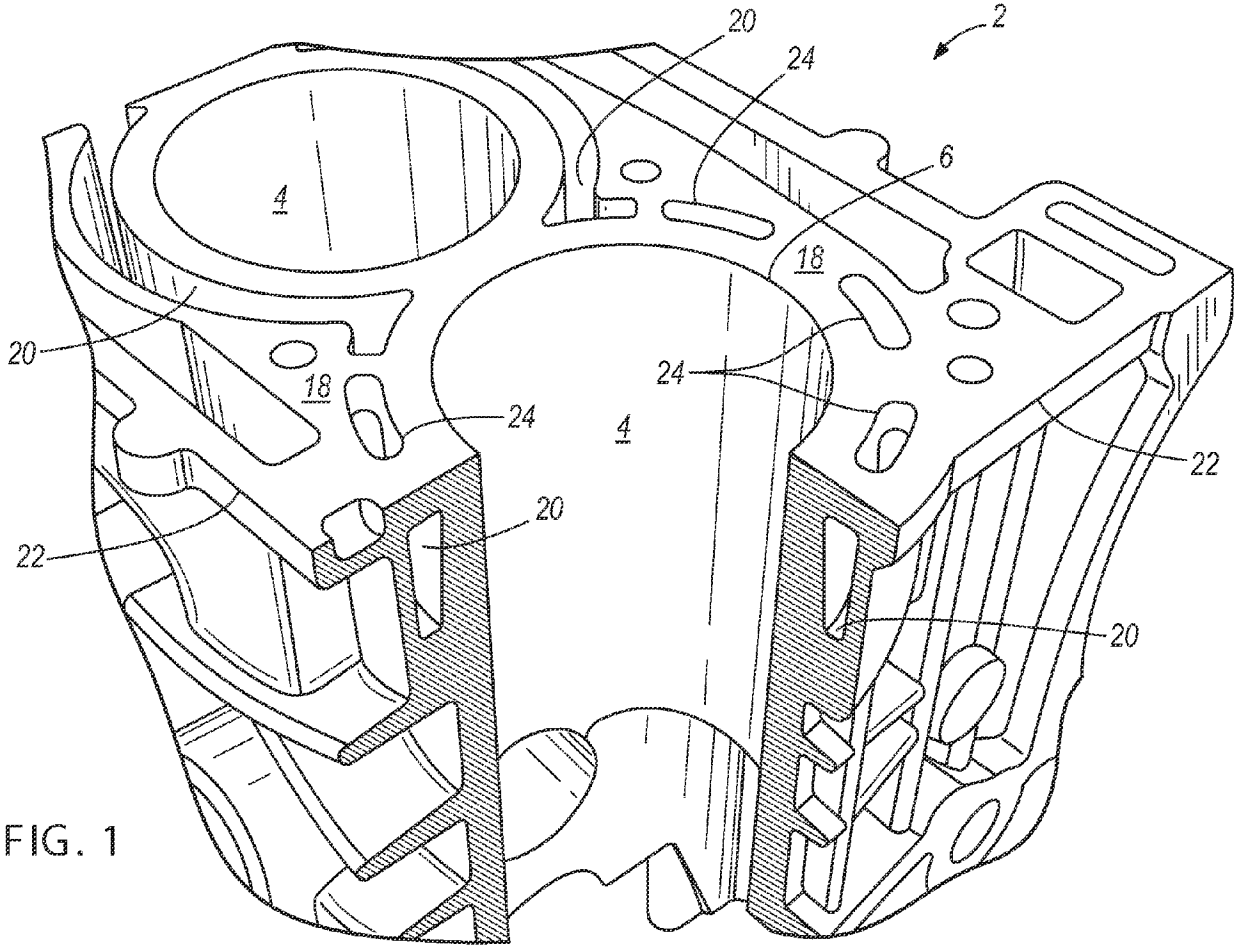
FIG. 1 is a perspective view of a closed deck engine block assembly constructed in accordance with the present disclosure.

FIG. 1 demonstrates a closed deck engine block 2 for use in a high pressure die cast engine block assembly in accordance with the present invention. The engine block is high pressure die cast, preferably in accordance with the method for casting an engine block assembly having at least one cast in place cylinder bore in the engine block and a closed head deck surface described herein.

Figure 3:
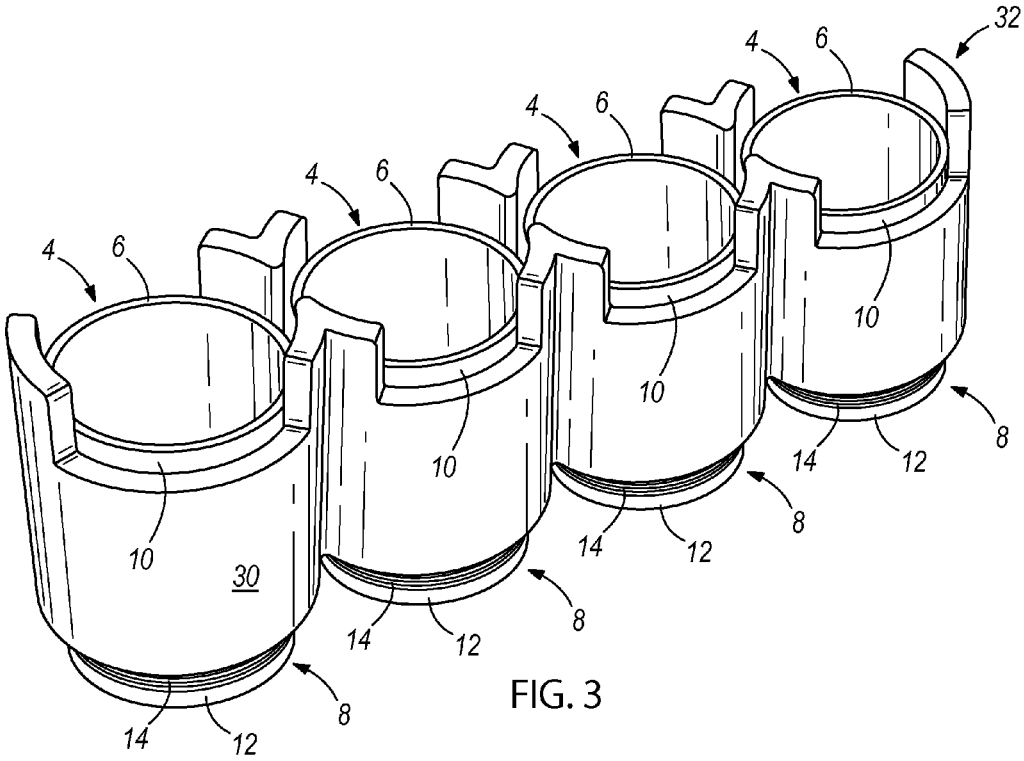
FIG. 3 is a perspective view of a composite salt and cylinder bore core that may be utilized in accordance with the present disclosure.
Figure 4:
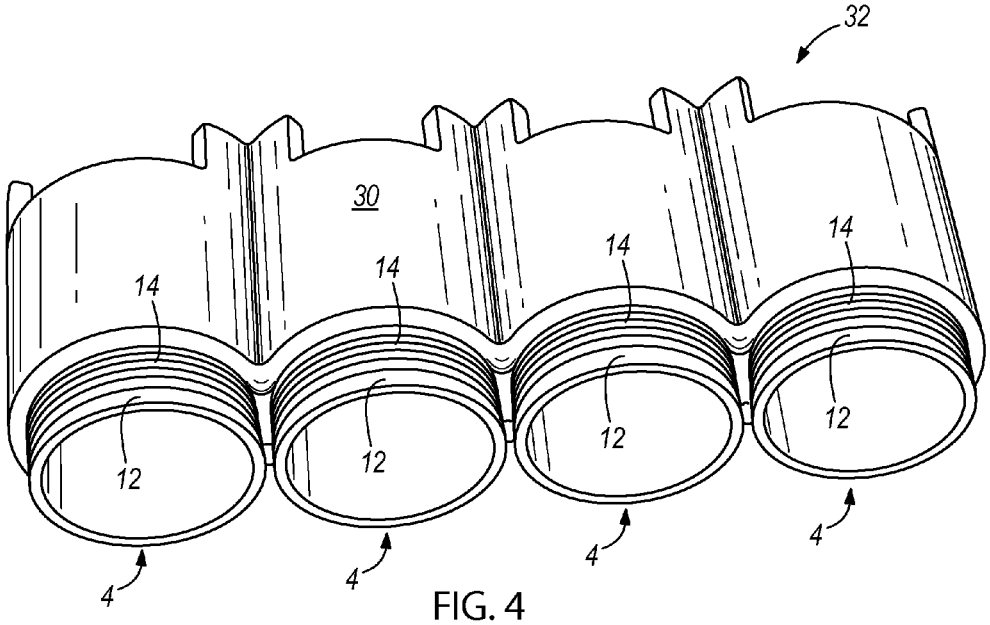
FIG. 4 is a second perspective view of a composite salt and cylinder bore core that may be utilized in accordance with the present disclosure.

As shown in FIG. 1, the closed deck engine block 2 includes at least two cylinder bores 4 in the engine block. The cylinder bores may be cast in place and include a top surface 6 and an outer surface 8. As shown in FIGS. 3 and 4, the outer surface 8 further includes an upper outer surface 10 and a lower outer surface 12. The lower outer surface 12 of the cylinder bores 4 may further define at least one surface area 14 for interfacing with the engine block during casting to cast the at least two cylinder bores 4 in place in the engine block 2.

Figure 2:
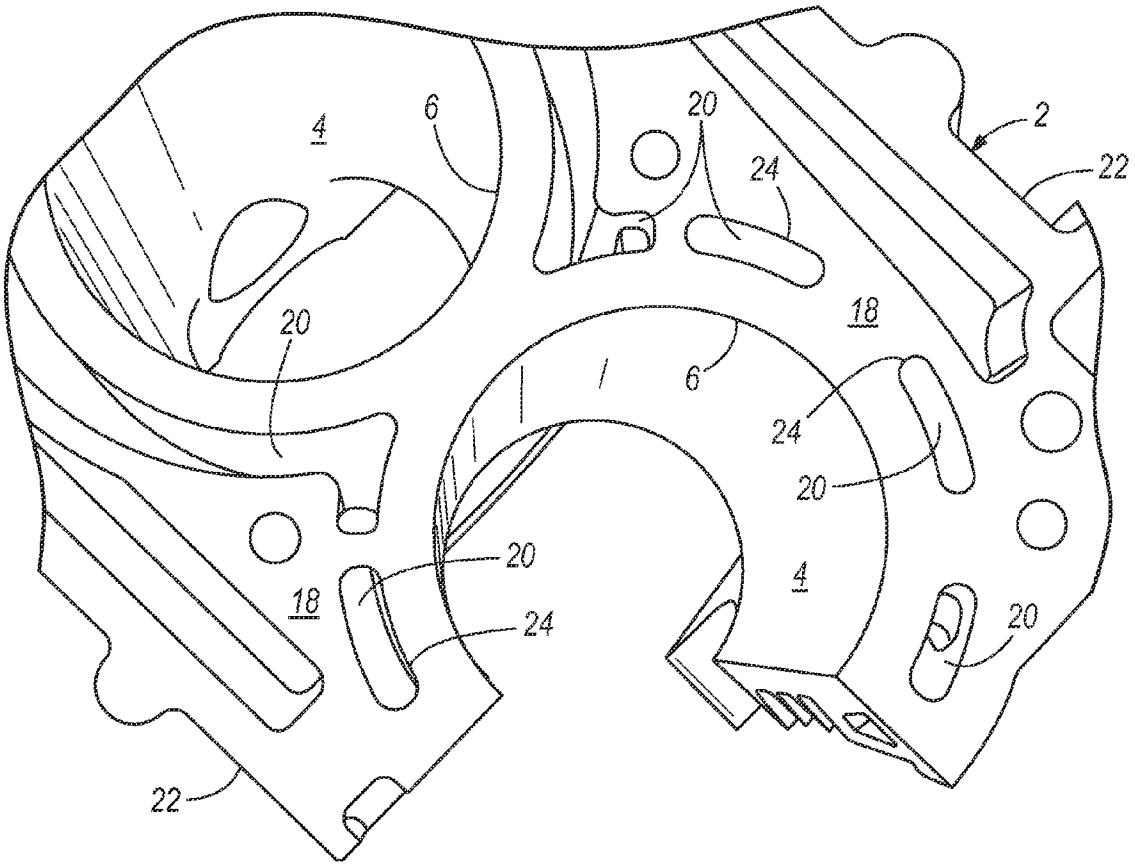
FIG. 2 is a top view of a closed deck engine block assembly constructed in accordance with the present disclosure.

Referring now to FIGS. 1 and 2, the closed deck engine block 2 includes a water jacket 20 that surrounds the upper outer surface 10 of the cylinder bores 4. The upper outer surface 10 of the cylinder bores 4 further defines an inner surface of the water jacket 20. A top surface of the water jacket 20 is at least partially closed by a head deck surface 18 extending from the top surface 6 of at least two cylinder bores to an outer perimeter 22 of the engine block 2.

Turning to FIGS. 3 and 4, the water jacket 20 is formed using a salt core 30 that surrounds at least some of the upper outer surface 10 of the cylinder bores 4. It will be recognized that a small portion of the upper surface 10 of the cylinder bores 4 may remain exposed to form the closed head deck surface 18 shown in FIGS. 1 and 2. The water jacket 20 provides an open passage between each cylinder bore 4 such that water may flow around an outer circumference of the upper outer surface 10 of the cylinder bores 4. The salt core 30 and at least two cylinder bores 4 define a composite core 32 for the high pressure die casting of the engine block assembly 2.

The closed deck engine block 2 may be cast using high pressure die casting with the following method. First the composite core 32 is formed by surrounding the outer, upper surface 10 of at least one cylinder bore 4 with the salt core 30. As noted, the salt core 30 will define the water jacket 20 in the final cast engine block 2. The composite core 32 may be formed by placing at least one cylinder bore 4 in a salt core mold having the specific water jacket designed desired. Liquid salt core material is then injected into the salt core mold to surround a substantial part of the outer, upper surface 10 of the cylinder bore or bores. In one embodiment, an uppermost portion of the outer, upper surface 10 of the cylinder bore 4 is not surrounded. The salt core material is then solidified to create the composite core 32. Once solidified, the composite core 32 may be removed from the salt core mold. Alternatively, the salt core portion 30 may be formed by injecting liquid salt core material into a salt core mold, with the salt core mold defining a water jacket 20 and an area for receiving at least one cylinder bore 4. The salt core material is allowed to solidify, and at least one cylinder bore 4 is pressed into the area for receiving at least one cylinder bore to form the composite core 32.

The composite core 32 is placed into a high pressure die casting mold for a closed deck engine block 2. The composite core is placed so that a lower outer surface 12, 14 of at least one cylinder bore 4 is exposed to the molten engine block alloy that will be injected into the mold. Placement of the composite core 32 may be accomplished by seating the lower outer surface 12, 14 of at least one cylinder bore 4 into a cylinder bore seat (not shown) in the high pressure die casting mold An engine block alloy is injected into the high pressure die casting mold, and the engine block alloys comes into contact with the exposed outer surfaces of the cylinder bores 4, particularly lower outer surface 12. As noted, lower surface 12 of the cylinder bores 4 may further define at least one surface area 14 for interfacing with the engine block during casting. In one embodiment, the additional surface area 14 comprises circumferential grooves. In this manner, the engine alloy interfaces with the exposed lower outer surface 12, 14 of the cylinder bore or bores so that each cylinder bore is cast into place in the engine block 2

The cast engine block 2 and composite core 32 are removed from the high pressure die casting mold as a single engine block assembly. The assembly is allowed to cool, and the salt core portion 30 may be dissolved out to finalize the forming the water jacket 20 and orifices 24 in the closed head deck surface 18.

Due to the nature of the ability of the salt core 30 to easily form complex external geometry, while being supported by the cylinder bores 4, the composite core 32 can be contoured in pull directions that more fragile sand cores cannot. This complexity also allows for the formation of a water jacket 20 that allows for cooling water to be concentrated on or diverted from areas of the cylinder bores 4 that require more or less cooling. Further, the salt core portion 30 of the composite core 32 is constructed such that the core 30 creates orifices 24 that operate as holding pocket locations extending through the head deck surface 18 and also into adjoining water passage inlets and outlets to create flushing channels sufficient to dissolve and wash away the salt core material 30 subsequent to the casting being solidified and cooled. The core 30 can be held in a manner with core prints through the side-walls only, eliminating any need for head deck core prints.

The engine block 2 may be constructed from an acceptable engine block alloy. In one embodiment the engine block alloy is an aluminum-silicon alloy. Preferably, the aluminum silicon alloy is selected from one of AA319, AA320, AA328, AA332, AA333, AA336, AA339, AA354, AA355, AA356, AA357, AA358, AA359, AA360, AA361, AA362, AA363, AA365, AA380, AA383, AA390, and AA391. Alternatively, the engine block 2 may be constructed of a magnesium alloy. If a magnesium alloy is used, one of AM-SC1, AJ-62, AZ-91, AZ-92, AM60A, and AM60B is preferred.

The cylinder bores 4 may be constructed of any acceptable material as known in the art, however, it should be recognized that the selected material will preferably have a melting point equal to or greater than the alloy used to cast the engine block 2 to avoid the engine block material from melting through the cylinder bore material. Accordingly, the cylinder bores may be constructed of a hypereutectic aluminum silicon alloy having a solidus melting point higher than the alloy of the engine block. In this regard, preferred materials are AA390 and AA391. Alternatively, the cylinder bore material may be cast iron, ductile iron, steel, or a ceramic composite material. Further, an interior surface or inner diameter of the cylinder bores 4 may be coated. The coating may be a ceramic coating or a chrome coating. In one embodiment the coating NIKASIL®. In another embodiment, the outer surface 8 of the cylinder bores 4 may be coated to resist erosion by the water in the water jacket 20. Preferred outer coatings include NIKASIL®, AA390 and AA391, particularly if the cylinder bores 4 are constructed from cast iron, ductile iron or steel.

The technology applies to both in-line and to VR geometry engine blocks. VR blocks use staggered cylinder bore spacing, and because of this are only cast using sand cast or permanent mold processes. Using a composite salt core 32 as explained above allows for high pressure die casting of this family of blocks as well as in-line geometries.

In the above description certain terms have been used for brevity, clearness and understanding. No unnecessary limitations are to be implied therefrom beyond the requirement of the prior art because such terms are used for descriptive purposes only and are intended to be broadly construed. The different systems and methods described herein above may be used in alone or in combination with other systems and methods. Various equivalents, alternatives and modifications are possible within the scope of the appended claims. Each limitation in the appended claims is intended to invoke interpretation under 35 USC §112, sixth paragraph only the terms "means for" or "step for" are explicitly recited in the respective limitation. White each of the method claims includes a specific series of steps for accomplishing certain control system functions, the scope of this disclosure is not intended to be bound by the literal order or literal content of steps described herein, and non-substantial differences or changes still fail within the scope of the disclosure,

What is claimed is:

1. A method for high pressure die casting of an engine block assembly having at least one cast in place cylinder bore in the engine block, and a closed head deck surface, the method comprising:

surrounding an outer, upper surface of at least one cast in place cylinder bore with a salt core to create a composite core, the salt core defining a water jacket;

placing the composite core into a high pressure die casting mold for a closed deck engine block;

injecting an engine block alloy into the high pressure die casting mold;

removing the cast engine block and composite core from the high pressure die casting mold as a single engine block assembly;

cooling the engine block, assembly; and dissolving the salt core portion of the composite core;

wherein the cylinder bore is a separate cast in place cylinder bore formed separately from the die casting of the engine block.

2. The method of claim 1, wherein the salt core further defines orifices in the closed head deck.

3. The method of claim 1, wherein the step of placing further comprises placing the composite core into a high pressure die casting mold for a closed deck engine block such that a lower outer surface of the at least one cylinder bore is exposed.

4. The method of claim 3, wherein the step of placing the composite core into a high pressure die casting mold for a closed deck engine block further comprises seating the lower outer surface of the at least one cylinder bore into at least one cylinder bore seat in the high pressure die casting mold.

5. The method of claim 3, wherein the step of injecting further comprises injecting an engine block alloy into the high pressure die casting mold such that the alloy interfaces with the exposed lower outer surface of the at least one cylinder bore so that the cylinder bore is cast into place in the engine block.

6. The method of claim 5, wherein the exposed lower outer surface of the at least one cylinder bore comprises additional surface area to interface with the engine block alloy.

7. The method of claim 6, wherein the additional surface area comprises circumferential grooves.

8. The method of claim 4, wherein the step of injecting further comprises injecting an engine block alloy into the high pressure die casting mold such that the alloy interfaces with the exposed lower outer surface of the at least one cylinder bore such that the cylinder bore is cast into place in the engine block.

9. The method of claim 8, wherein the exposed lower outer surface of the at least one cylinder bore comprises additional surface area to interface with the engine block alloy.

10. The method of claim 9, wherein the additional surface area comprises circumferential grooves.

11. The method of claim 1, wherein the step of injecting an engine, block alloy into the high pressure die casting mold further comprises injecting an aluminum silicon alloy selected from AA319, AA320, AA328, AA332, AA333 AA336, AA339, AA354 AA355, AA356, AA357, AA358, AA359, AA360, AA361, AA362, AA363, AA365, AA380, AA383, AA390, and AA391.

12. The method of claim 1, wherein the step of injecting an engine block alloy into the high pressure die casting mold further comprises injecting a magnesium alloy selected from AM-SC1, AJ-62, AZ-91, AZ-92, AM60A, and AM60B.

13. The method of claim 1, wherein the at least one cylinder bore is constructed of a material selected from: a hypereutectic aluminum silicon alloy having a solidus melting point higher than the alloy of the engine block; cast iron: ductile iron; steel; or a ceramic composite material.

14. The method of claim 1, wherein the step of surrounding an outer, upper surface of at least one cylinder bore with a salt core further comprises the steps of placing at least one cylinder bore in a salt core mold; injecting liquid salt core material into the mold to surround the outer, upper surface of at least one cylinder bore; solidifying the salt core material to create a composite core; and removing the composite core from the salt core mold.

15. The method of claim 1, wherein the step of surrounding an outer, upper surface of at least one cylinder bore with a salt core further comprises the steps of injecting liquid salt core material into a salt core mold, the salt core mold defining a water jacket and an area for receiving at least one cylinder bore; solidifying the salt core material; removing the salt core from the mold; and pressing at least one cylinder bore into the area for receiving at least one cylinder bore to form a composite core.

* * * * *